US011702248B2

(12) United States Patent
Shi

(10) Patent No.: US 11,702,248 B2
(45) Date of Patent: Jul. 18, 2023

(54) ONE-WAY AIR OUTLET CHANNEL FOR VACUUM COMPRESSION BAG AND VACUUM COMPRESSION BAG HAVING ONE-WAY AIR OUTLET CHANNEL

(71) Applicant: ZHONGSHAN TAILI HOUSEHOLD PRODUCTS MANUFACTURING CO., LTD., Guangdong (CN)

(72) Inventor: Zhengbing Shi, Guangdong (CN)

(73) Assignee: ZHONGSHAN TAILI HOUSEHOLD PRODUCTS MANUFACTURING CO., LTD., Guangdong (CN)

( * ) Notice: Subject to any disclaimer, the term of this patent is extended or adjusted under 35 U.S.C. 154(b) by 0 days.

(21) Appl. No.: 17/288,921

(22) PCT Filed: Nov. 20, 2019

(86) PCT No.: PCT/CN2019/119733
§ 371 (c)(1),
(2) Date: Apr. 27, 2021

(87) PCT Pub. No.: WO2020/103868
PCT Pub. Date: May 28, 2020

(65) Prior Publication Data

US 2021/0394964 A1 Dec. 23, 2021

(30) Foreign Application Priority Data

Nov. 21, 2018 (CN) ..... 201811390395.5
Nov. 21, 2018 (CN) ..... 201821929122.9

(51) Int. Cl.
*B65D 33/01* (2006.01)
*B65D 81/20* (2006.01)

(52) U.S. Cl.
CPC ..... *B65D 33/01* (2013.01); *B65D 81/2023* (2013.01); *B65D 2205/00* (2013.01); *B65D 2205/02* (2013.01)

(58) Field of Classification Search
CPC .... B65D 31/14; B65D 33/01; B65D 81/2023; B65D 2205/00; B65D 2205/02; B65D 75/5855; B65D 75/5866; B65D 77/225
(Continued)

(56) References Cited

U.S. PATENT DOCUMENTS 4,449,243 A 5/1984 Platel
7,452,132 B2 * 11/2008 Tang ..... B65D 33/2508 383/103
2009/0190863 A1 * 7/2009 Calvo ..... B65D 33/01 383/100

FOREIGN PATENT DOCUMENTS

CN 201144057 11/2008
CN 201381055 1/2010
(Continued)

OTHER PUBLICATIONS

DE102007062814Translation (Year: 2009).*
(Continued)

*Primary Examiner* — Jes F Pascua
*Assistant Examiner* — Nina K Attel
(74) *Attorney, Agent, or Firm* — JCIP Global Inc.

(57) ABSTRACT

A one-way air outlet channel is disposed inside a vacuum compression bag. The one-way air outlet channel includes an air inlet opening, a horizontal air channel, inclined air channel and vertical air channel and an air outlet opening in communication with one another in sequence. One end of the horizontal air channel is the air inlet opening in communication with a space inside the bag body, and the other end of the horizontal air channel is in communication with the inclined air channel. A bottom end of the vertical air
(Continued)

channel is in communication with the air outlet opening, and a top end is in communication with the inclined air channel, such that at least two corner points are formed, at a location where the horizontal air channel connects the inclined air channel and at a location where the inclined air channel connects the vertical air channel.

14 Claims, 14 Drawing Sheets

(58) Field of Classification Search
USPC ..... 383/100, 101, 103
See application file for complete search history.

(56) References Cited

FOREIGN PATENT DOCUMENTS

| | | | | |
|---|---|---|---|---|
| CN | 201647372 | | 11/2010 | |
| CN | 203268570 | | 11/2013 | |
| CN | 204548818 | | 8/2015 | |
| CN | 205131945 | | 4/2016 | |
| CN | 206827231 | | 1/2018 | |
| CN | 109502162 | | 3/2019 | |
| CN | 209321559 | | 8/2019 | |
| CN | 209567322 | | 11/2019 | |
| DE | 102007062814 | A1 * | 6/2009 | ..... B65D 33/01 |
| FR | 2975084 | A3 * | 11/2012 | ..... B65D 81/2023 |

OTHER PUBLICATIONS

"International Search Report (Form PCT/ISA/210) of PCT/CN2019/119733", dated Feb. 19, 2020, with English translation thereof, pp. 1-6.

* cited by examiner

ONE-WAY AIR OUTLET CHANNEL FOR VACUUM COMPRESSION BAG AND VACUUM COMPRESSION BAG HAVING ONE-WAY AIR OUTLET CHANNEL

CROSS-REFERENCE TO RELATED APPLICATION

This application is a 371 of international application of PCT application serial no. PCT/CN2019/119733, filed on Nov. 20, 2019, which claims the priority benefit of China application no. 201811390395.5, filed on Nov. 21, 2018, and China application no. 201821929122.9, filed on Nov. 21, 2018. The entirety of each of the above mentioned patent applications is hereby incorporated by reference herein and made a part of this specification.

BACKGROUND

Technical Field

The invention relates to the field of vacuum compression bags, in particular to a one-way air outlet channel for vacuum compression bag and a vacuum compression bag having the one-way air outlet channel.

Description of Related Art

Conventional vacuum compression bag is equipped with a vacuum air outlet valve. As shown in FIG. 1 to FIG. 2, a conventional vacuum compression bag is characterized by the split at the lower part of the bag body, which can make the bag body stand upright. The vacuum compression bag includes a front bag panel 1, a rear bag panel 2, and a bottom bag panel 3. The bottom bag panel 3 is connected to the lower part of the bag body formed by the front bag panel 1 and the rear bag panel 2, thereby forming a Y-shaped split structure at the lower part of the bag body.

Specifically, the bottom bag panel 3 is divided into a first bottom surface 31 and a second bottom surface 32 by a fold line. The outer edge of the first bottom surface 31 parallel to the fold line is pressed against the bottom edge of the front bag panel 1. Similarly, the outer edge of the second bottom surface 32 parallel to the fold line is pressed against the bottom edge of the rear bag panel 2. The sections X1 at both sides of the first bottom surface 31 are respectively pressed against the lowers section Y1 at both sides of the front bag panel 1. The sections X2 at both sides of the second bottom surface 32 are respectively pressed against the lower sections Y2 at both sides of the rear bag panel 2. The upper sections Z1 at both sides of the front bag panel 1 are respectively pressed against the upper sections Z2 at both sides of the rear bag panel 2, thereby forming the bag body. A bag opening is formed between the top side of the front bag panel 1 and the top side of the rear bag panel 2. The bag opening is further provided with a buckle mechanism 5. The upper opening of the bag body is provided with a vacuum air outlet valve 4. The shortcoming of the conventional vacuum compression bag is as follows.

When in using, the vacuum compression bag can only be vacuumed by using the vacuum air outlet valve and the vacuum air outlet pump both. Therefore, it is not user friendly in terms of convenience. That is to say, the user needs to additionally purchase a vacuum air outlet pump. If the user chooses to buy an electric vacuum air outlet pump, which is undoubtedly a large additional financial burden for the consumer. If the user uses a cheap manual vacuum air outlet pump to achieve the vacuuming purpose, the vacuuming process takes a lot of time and efforts. Besides, the air expelling efficiency is low, especially for vacuuming some vacuum bags with a large size, the air expelling efficiency will be lower, and it takes much more time to expel the air.

In view of the above technical shortcomings, the inventor of the invention developed a simple air expelling method, which is to directly set a one-way air outlet channel for expelling air at the bottom of the vacuum compression bag. However, during the research and development process, it was found that many types of one-way air outlet channels have unsatisfactory air expelling effect and/or air leakage. For example, one-way air outlet channels are provided with two staggered air channels arranged at the bottom of the bag body (see FIG. 13 and FIG. 15), which is more likely to achieve air exhaust more smoothly. However, two or three days later, the air from the outside will flow back to the bag body through the one-way air outlet channel. Therefore, the one-way air outlet channel cannot ensure the airtightness in the bag body.

SUMMARY

The first purpose of the invention is to provide a one-way air outlet channel for a vacuum compression bag. The one-way air outlet channel has a simple design, rapid air outlet speed, and strong sealing tightness after air is expelled.

The second purpose of the invention is to provide a vacuum compression bag having the one-way air outlet channel.

The first purpose of the invention is achieved through the following technical solution.

A one-way air outlet channel is adapted for a vacuum compression bag. The vacuum compression bag has a bag body having a split structure. The bag body of the vacuum compression bag includes a front bag panel, a rear bag panel and at least one connecting panel. Specifically, the connecting panel is divided into a first connecting surface and a second connecting surface along a fold line. The one-way air outlet channel is made of flexible material, is arranged in the vacuum compression bag, and is located between the front bag panel and the first connecting surface and/or between the rear bag panel and the second connecting surface. The one-way air outlet channel includes an air inlet opening, a horizontal air channel, an inclined air channel, a vertical air channel arranged and an air outlet opening in communication with one another in sequence. One end of the horizontal air channel is the air inlet opening in communication with the space inside the bag body, and the other end of the horizontal air channel is in communication with the inclined air channel. An air outlet opening in communication with the outside is provided on the bag body of the vacuum compression bag. A bottom end of the vertical air channel is in communication with the air outlet opening, the top end of the vertical air channel is in communication with the inclined air channel, such that at least two corner points are formed at a location where the horizontal air channel connects the inclined air channel and at a location where the inclined air channel connects the vertical air channel.

Preferably, the one-way air outlet channel is formed by pressing the front bag panel and the first connecting surface and/or pressing the rear bag panel and the second connecting surface.

The one-way air outlet channel of the invention is formed by pressing two different bag panels of the bag body, and a channel wall is a wall of the flexible bag body. After the air is completely expelled from the vacuum compression bag, the one-way air outlet channel is flattened under the effect of atmospheric pressure, such that the one-way air outlet channel is blocked, thereby realizing the sealing of the one-way air outlet channel.

The one-way air outlet channel of the invention is designed as a horizontal air channel, an inclined air channel and a vertical air channel that cooperate with each other. The two ends of the inclined air channel are respectively in communication with the horizontal air channel that connects the air inlet opening and the vertical air channel that connects the air outlet opening. When air is expelled, due to the pressure is applied manually to the bag body, the air can be expelled smoothly to enter the one-way air outlet channel from the air inlet opening. The expelled air sequentially passes through the horizontal air channel, the inclined air channel and the vertical air channel to reach the air outlet opening. As such, the air inside the vacuum compression bag can be expelled to the outside more easily. Thereafter, the vacuum compression bag and the one-way air outlet channel are contracted and flattened under the effect of atmosphere pressure, and the one-way air outlet channel is blocked and sealed. In the one-way air outlet channel of the invention, since two corner points are formed at a location where the horizontal air channel connects the inclined air channel and at a location where the inclined air channel connects the vertical air channel, when the air passes through the one-way air outlet channel, a flowing direction of the air changes twice, which increases the difficulty for the air to flow back. In addition, with the negative pressure effect of the sealed bag body, it is difficult for air to flow back to the bag body through the one-way air outlet channel. Accordingly, the airtightness of the vacuum compression bag is significantly increased, and the bag body can remain in a vacuum state for a long time.

The connecting panel of the invention can be a bottom bag panel or a top bag panel. When the connecting panel is a bottom bag panel, the bag body is a structure with lower split. When the connecting panel is a top bag panel, the bag body is a structure with upper split. When a number of the connecting panel is two, which are respectively the top bag panel and the bottom bag panel, the bag body is a structure with upper and lower splits.

The air outlet opening of the invention can be arranged on a bottom/top edge of the bag body, or on a lateral side close to the bottom/top edge.

A recommended embodiment of the invention is that the one-way air outlet channel is arranged at the corner of the vacuum compression bag. When the air in the vacuum compression bag is largely expelled, the internal pressure inside the bag is lower than that of the outside. Under the effect of atmosphere pressure, the vacuum compression bag is squeezed and contracted and deformed. However, due to the relatively large degree of space freedom at the corners of the bag, the corners of the bag are less affected after the bag body is compressed and deformed. Therefore, when the one-way air outlet channel is arranged at the corner of the bag body, the air outlet opening is less likely to be blocked immediately when the bag body is deformed, thereby ensuring that the air inside the vacuum compression bag can be smoothly expelled to the outside.

In the invention, in order to expel the air in the vacuum compression bag more quickly, the horizontal air channel is arranged along the top edge or bottom edge of the vacuum compression bag. The air inlet opening faces a center of the top edge or bottom edge of the vacuum compression bag. The air outlet opening is arranged at the lateral side of the vacuum compression bag, and close to the top edge or bottom edge of the bag body. In the air expelling process of the vacuum compression bag, since the air inside the bag is mainly distributed at the top portion or bottom portion of the bag body, by arranging the air inlet opening to face the center of the top edge/or bottom edge of the vacuum compression bag, the air can be expelled to the outside of the bag body more quickly.

In the invention, in order to increase the number of times that the air changes its flowing direction when passing through the one-way air outlet channel to further improve the airtightness, in a preferred embodiment of the invention, the horizontal air channel includes a first horizontal air channel and a second horizontal air channel. The first horizontal air channel and the second horizontal air channel are parallel to each other. The air inlet opening is located at one end of the first horizontal air channel, and the other end of the first horizontal air channel communicates with one end of the second horizontal air channel, and a corner point is formed between the first horizontal air channel and the second horizontal air channel, such that the horizontal air channels form a U-shaped structure. The other end of the second horizontal air channel communicates with the inclined air channel. With such design, the one-way air outlet channel has for corner points, which further improves airtightness.

In a preferred embodiment of the invention, the inclined section air channel can be a straight inclined air channel or an arc inclined air channel. No matter whether the inclined section is a straight inclined air channel or an arc inclined air channel, it is possible to achieve the air-expelling effect and airtightness effect both.

Diameters of the air inlet opening, the horizontal air channel, the inclined air channel, the vertical air channel and the air outlet opening range from 20 to 60 mm. The diameters within this range can make the one-way air outlet channel to achieve an ideal air-expelling effect.

A length of the horizontal air channel or the first horizontal air channel and the second horizontal air channel is 40 to 150 mm, a length of the inclined air channel is 100 to 250 mm, and a length of the vertical air channel is 100 to 300 mm. The lengths within this range allow the one-way air outlet channel to have a sufficient length and thus it is more difficult for the air to flow back, which further improves the airtightness of the vacuum compression bag.

An obtuse angle $\alpha$ is formed between the inclined air channel and the lateral side of the bag body, and the obtuse angle $\alpha$ is 120° to 160°. With the angle within this range, the ideal airtightness effect can be achieved.

The second purpose of the invention is achieved through the following technical solution.

A vacuum compression bag includes a one-way air outlet channel. A bag body of the vacuum compression bag includes a front bag panel, a rear bag panel and at least one connecting panel. The connecting panel is divided into a first connecting surface and a second connecting surface by a fold line. Two lateral sides of the first connecting surface are respectively pressed against at least one end section on two lateral sides of the front bag panel, that is, the upper section and/or lower section to form the first upper lateral side or the first lower lateral side, which are all referred to as the first lateral sides. Correspondingly, two lateral sides of the second connecting surface are respectively pressed against at least one end section of two lateral sides of the rear bag panel, that is, the upper section and/or lower section to form the second upper lateral side and/or the second lower lateral side, which are all referred to as the second lateral sides.

Remaining portions of the two lateral sides of the front bag panel and remaining portions of the two lateral sides of the rear bag panel are pressed against each other to form a third lateral side. The first lateral side, the second lateral side and the third lateral side together form the lateral side of the bag body. A bag opening is formed at the upper end of the bag body or formed by the top edge of the front bag panel and the top edge of the rear bag panel. Or, the bag opening of the bag body is formed by the outer edge of the second connecting surface parallel to the fold line and the top edge of the rear bag panel. A buckle mechanism is arranged at the bag opening for sealing the bag opening. The one-way air outlet channel is further provided in the bag body.

In the invention, the one-way air outlet channel can be formed by pressing the front bag panel and the first connecting surface, and/or formed by pressing the rear bag panel and the second connecting surface. The one-way air outlet channel formed through the above approach is not blocked immediately and unable to expel air to the outside smoothly when the object is placed in the vacuum compression bag.

The vacuum compression bag in the invention may have various forms.

The connecting panel in the invention may be a top bag panel, which forms a split structure with an upper part of the bag body. The top bag panel is divided into a first top surface and a second top surface along a fold line. The outer edge of the second top surface parallel to the fold line is pressed against the top edge of the rear bag panel to form the first top edge. The bag opening is formed between the outer edge of the first top surface parallel to the fold line and the top edge of the front bag panel. The two lateral sides of the first top surface are respectively pressed against the upper sections at the two lateral sides of the front bag panel to form the first upper lateral side. The two lateral sides of the second top surface are respectively pressed against the upper sections at the two lateral sides of the rear bag panel to form the second upper lateral side. The remaining portions of the two lateral sides of the front bag panel and the remaining portions of the two lateral sides of the rear front panel are pressed against each other to form the third lateral side.

Preferably, the one-way air outlet channel is provided at each of the four corners of the vacuum compression bag formed between the first top surface and the front bag panel, and between the second top surface and the rear bag panel. The vacuum compression bag designed in this way enables the air inside the vacuum compression bag to be expelled to the outside through the four one-way air outlet channels simultaneously, thereby improving the efficiency of expelling air by pressing and making the air be expelled faster.

The connecting panel of the invention may also be a bottom bag panel, which forms the split structure with a lower part of the bag body. The bottom bag panel is divided into a first bottom surface and a second bottom surface along a fold line. The outer edge of the first bottom surface parallel to the fold line is pressed against the bottom edge of the front bag panel to form a first bottom edge. The outer edge of the second bottom surface parallel to the fold line is pressed against the bottom edge of the rear bag panel to form a second bottom edge. The two lateral sides of the first bottom surface are respectively pressed against the lower sections at the two lateral sides of the front bag panel to form a first lower lateral side. The two lateral sides of the second bottom surface are respectively pressed against the lower sections at the two lateral sides of the rear bag panel to form a second lower lateral side. The remaining portions of the two lateral sides of the front bag panel and the remaining portions of the two lateral sides of the rear bag panel, including middle sections and the upper sections of the two lateral sides, are pressed against each other to form the third lateral side. The first lower lateral side, the second lower lateral side and the third lateral side together constitute the lateral side of the bag body, and the top edge of the front bag panel and the top edge of the rear bag panel form a bag opening.

The first lower lateral side and the second lower lateral side of the invention can be pressed together to form a reinforced lateral side.

Preferably, the one-way air outlet channel is provided at each of the four corners of the bag formed between the first bottom surface and the front bag panel, and between the second bottom surface and the rear bag panel.

The connecting panel of the invention may also include two connecting panels, which are the top bag panel and the bottom bag panel respectively, that is, they form a split structure respectively with the upper part and the lower part of the bag body, which is a combination in which the upper part of the bag body has a split structure and the lower part of the bag body has a split structure. The lateral side of the bag body is formed with an upper split through the first upper lateral side, the second upper lateral side and the third lateral side, and formed with a lower split through the first lower lateral side, the second lower lateral side and the third lateral side. The third lateral side is the middle section of the lateral side of the bag body.

The invention may be further be modified as follows.

The obtuse angle $\alpha$ is formed between the inclined air channel of the one-way air outlet channel and the lateral side of the bag body, the one-way air outlet channel is further provided with a tear-proof arc-shaped hot press block arranged at a position where the obtuse angle forms. When the vacuum compression bag is pressed to expel air, the arc-shaped hot pressure block can share the supporting force of the bag body, so that the stress is dispersed, the strength of the bag body is therefore improved. Therefore, it is possible to prevent the bag body from being broken at the position where the stress is concentrated, thereby increasing the service life of the vacuum compression bag.

A junction A is formed among the first lateral side, the second lateral side and the third lateral side. Under the condition that the tear-proof arc-shaped hot press block is formed in the manner of hot pressing at one side with obtuse angle $\alpha$ at the inclined section of the one-way air outlet channel, the distance between the horizontal tangent of the arc-shaped hot press block and the junction A ranges from 5 to 20 mm. With the distance within this range, a good tear-proof effect can be achieved. The first lateral side can be the first upper lateral side or the first lower lateral side. The second lateral side can be the second upper lateral side or the second lower lateral side.

Preferably, the top surface of the top bag panel is provided with an interposing layer, and an accommodating space is formed between the interposing layer and the top surface of the top bag panel for the hard press plate to be movably inserted therein.

Compared with the background art, the invention has the following advantageous effects.

1. With the one-way air outlet channel of the invention, after the vacuum compression bag is filled with objects, it is only necessary to seal the bag opening and press the vacuum compression bag, and then the air inside the bag body can be expelled to the outside through the one-way air outlet channel. The one-way air outlet channel and the bag body are vacuumed and sealed by being squeezed and deformed under the effect of pressure difference inside and outside the bag. There is no need to use a vacuum air outlet pump, the operation is easy and the cost is low.

2. The one-way air outlet channel of the invention includes at least two corner points. When air flows through the one-way air outlet channel, the flowing direction of the air at least changes twice, thereby effectively increasing the difficulty for the air from the outside to enter the bag body through the one-way air outlet channel, and the vacuum compression bag can therefore maintain in the vacuum state.

3. When the vacuum compression bag is squeezed and compressed and deformed, due to the relatively large degree of space freedom at the corners of the bag, the corners of the bag are less affected after the bag body is compressed and deformed. Therefore, the one-way air outlet channel arranged at the corner of the bag body is less likely to be blocked immediately when the bag body is deformed, thereby ensuring that the air inside the vacuum compression bag can be smoothly expelled to the outside.

4. In the invention, the air inlet opening is arranged to face the center of the top portion/or bottom portion of the vacuum compression bag body. In the air expelling process of the vacuum compression bag, since the air inside the bag is mainly distributed at the top portion or bottom portion of the bag body, through such design, the air can be expelled to the outside of the bag body more quickly.

5. When the air outlet opening of the invention is located at the lateral portion of the bag body away from the corner of the bag body, the position near the junction A makes the air channel to open easily when the bag body is compressed to expel air, and the air is likely to flow back, which affects the sealing effect. Therefore, by arranging the air outlet opening at the lateral portion of the bag body or a position at the bottom portion near the corner, it is possible to effectively prevent the junction A of the vacuum compression bag from being broken in the process of pressing and expelling air.

6. The diameters of the air inlet opening, the horizontal air channel, the inclined air channel, the vertical air channel and the air outlet opening range from 20 to 60 mm. The diameters within this range can make the one-way air outlet channel to achieve an ideal air-expelling effect.

7. The length of the horizontal air channel ranges from 40 to 150 mm, the length of the inclined air channel ranges from 100 to 250 mm, and the length of the vertical air channel ranges from 100 to 300 mm. The lengths within this range allow the one-way air outlet channel to have a sufficient length and thus it is more difficult for the air to flow back, which further improves the airtightness of the vacuum compression bag.

An obtuse angle $\alpha$ is formed between the inclined air channel and the lateral side of the bag body, and the obtuse angle $\alpha$ ranges from 120° to 160°. With the angle within this range, the ideal airtightness effect can be achieved.

BRIEF DESCRIPTION OF THE DRAWINGS

The invention will be further explained through the accompanying drawings.

DESCRIPTION OF THE EMBODIMENTS

The invention will be further described by specific embodiments below.

Embodiment 1

Figure 1:
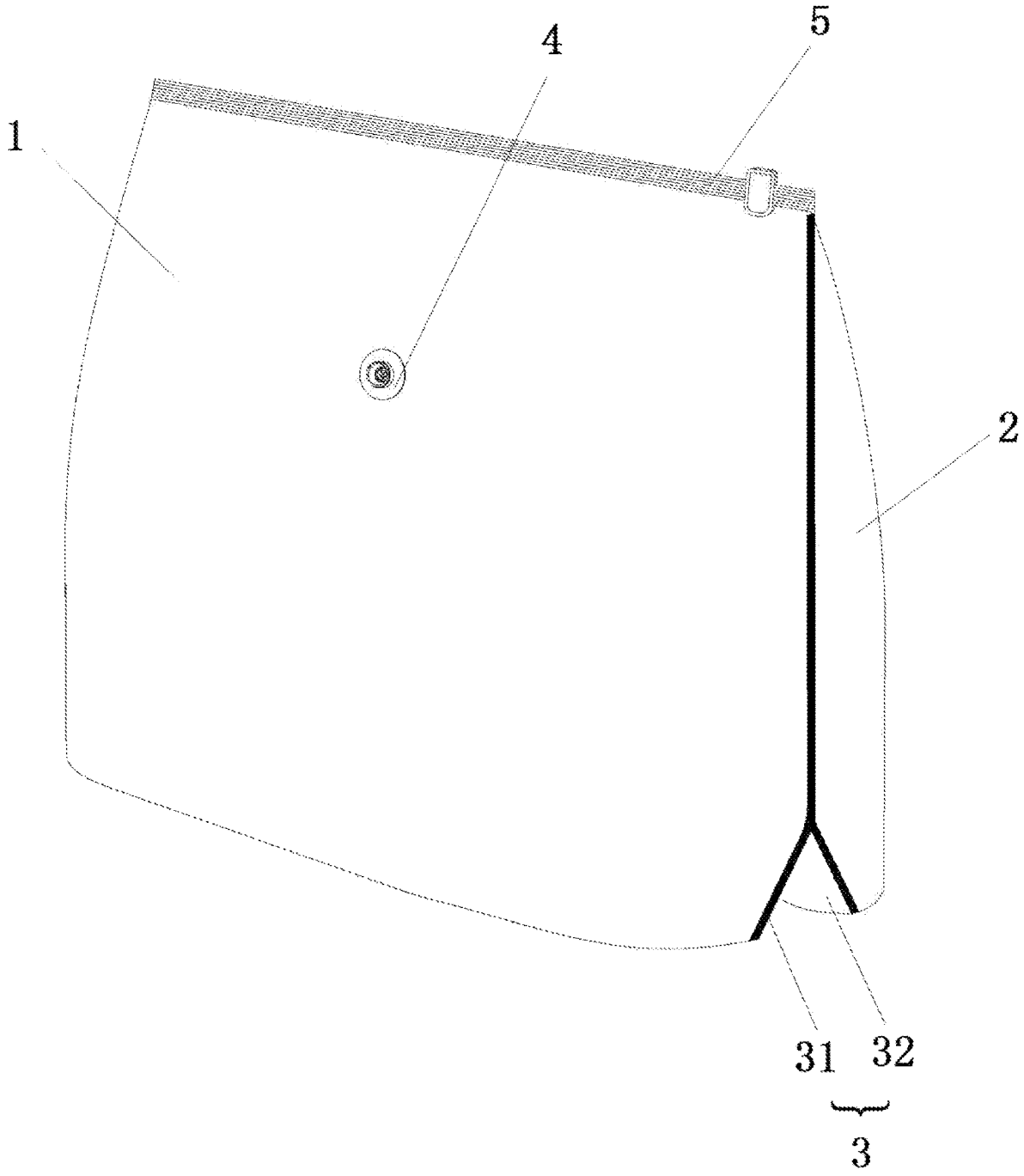
FIG. 1(Prior Art)
FIG. 1 is a three-dimensional schematic view of a conventional vacuum compression bag with a split structure.
Figure 2:
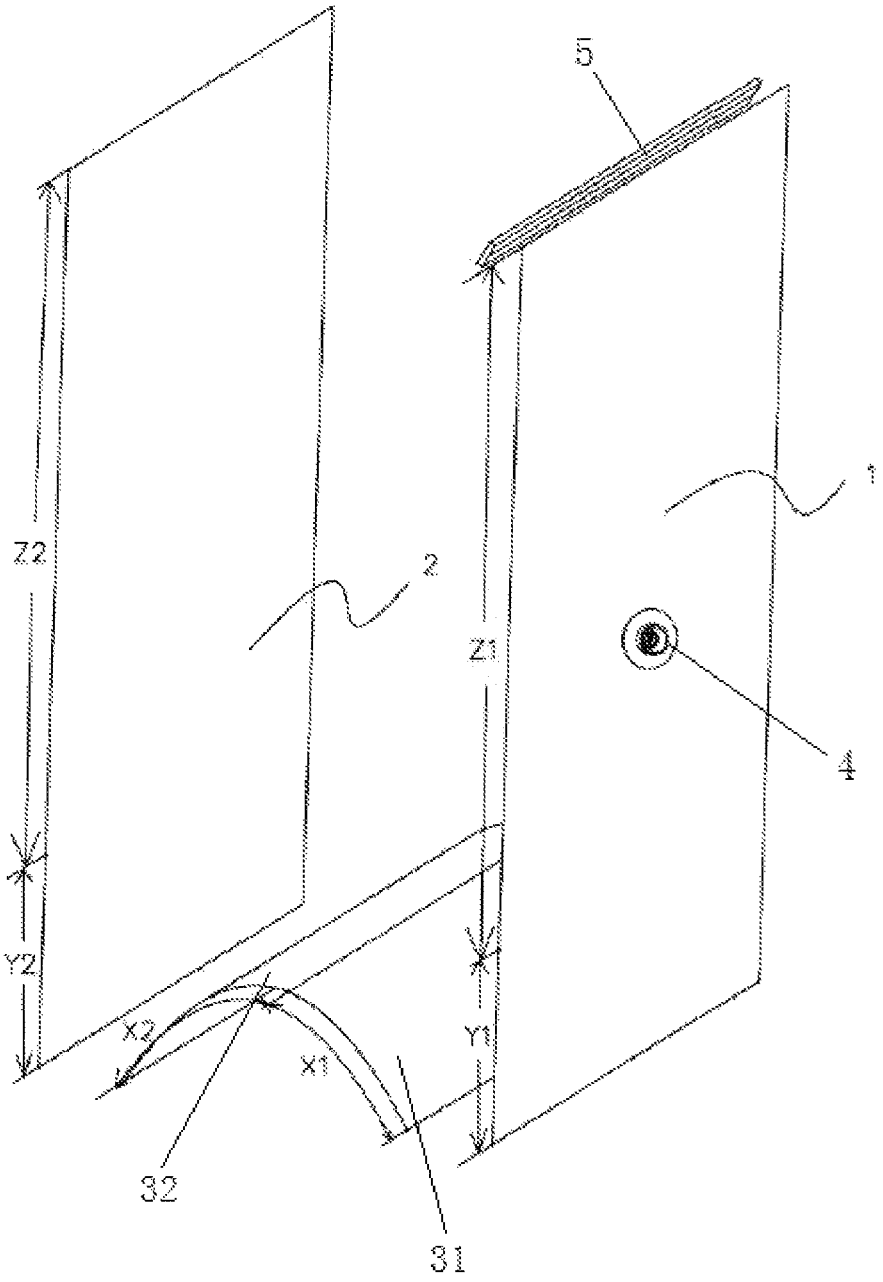
FIG. 2(Prior Art)
FIG. 2 is a schematic exploded view of a conventional vacuum compression bag with a split structure.
Figure 3:
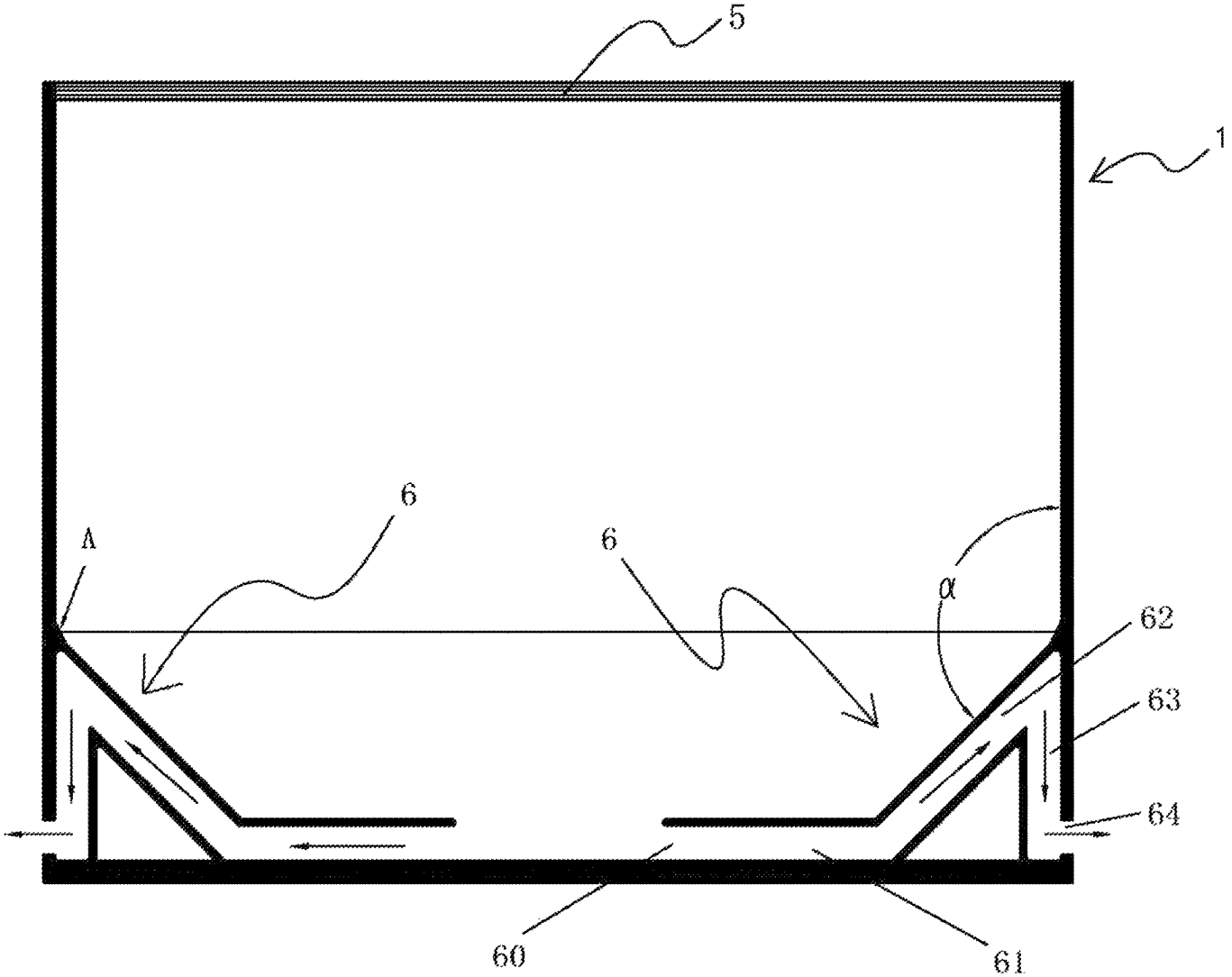
FIG. 3 is a front view of the vacuum plastic bag with one-way air outlet channel in embodiment 1.

As shown in FIG. 3, the one-way air outlet channel 6 is arranged in a vacuum compression bag. The one-way air outlet channel 6 includes a horizontal air channel 61, an inclined air channel 62, and a vertical air channel 63 that are in communication in sequence. A first corner point is formed at the position where the horizontal air channel 61 and the inclined air channel 62 are connected. A second corner point is formed at the position where the inclined air channel 62 is connected with the top end of the vertical air channel 63. An air inlet opening 60 is provided at one end of the horizontal air channel 61 away from the inclined air channel 62. An air outlet opening 64 is provided on the bag body of the vacuum compression bag. The bottom end of the vertical air channel 63 is in communication with the air outlet opening 64.

The vacuum compression bag is a vacuum compression bag with a split structure on a bag body, and the split structure is located at the bottom portion of the bag body. The bag body of the vacuum compression bag includes a front bag panel 1, a rear bag panel 2 and a bottom bag panel 3. The bottom bag panel 3 is divided into a first bottom surface 31 and a second bottom surface 32 by a fold line. The two lateral sides of the first bottom surface 31 are pressed against the lower sections at the two lateral sides of the front bag panel 1 to form a first lower lateral side. The two lateral sides of the second bottom surface 32 are pressed against the lower sections at the two lateral sides of the rear bag panel 2 to form a second lower lateral side. The remaining portions of the two lateral sides of the front bag panel 1 and the remaining portions of the two lateral sides of the rear bag panel 2 are pressed against each other to form the third lateral side. The first lower lateral side, the second lower lateral side and the third lateral side together constitute the lateral side of the vacuum compression bag.

A bag opening is formed between the top side of the front bag panel 1 and the top side of the rear bag panel 2. The bag opening is further provided with a buckle mechanism 5 for sealing the bag opening.

Two one-way air outlet channels 6 are pressed between the front bag panel 1 and the first bottom surface 31, and are separately located on the left and right sides of the vacuum plastic bag. The horizontal air channel 61 is closely attached to the bottom of the bag body, and the vertical air channel 63 is closely attached to the first lower lateral side. An obtuse angle α is formed between the inclined air channel 62 and the third lateral side, and the angle α is 120° to 160°. The air inlet opening 60 faces the center of the bottom of the bag body, and the air outlet opening 64 is provided at the bottom of the first lower lateral side. When in use, after putting the object into the vacuum compression bag, the bag opening is sealed by the buckle mechanism 5, and then the bag body of the vacuum compression bag is squeezed, so that the air in the bag body can be expelled to the outside through the one-way air outlet channel 6. The channel wall of the one-way air outlet channel 6 is a flexible bag wall. When air is expelled from the vacuum compression bag, the one-way air outlet channel 6 is flattened under the effect of atmosphere pressure, so that the one-way air outlet channel 6 is blocked, so as to realize the sealing of the bag body. If air from the outside flows back into the bag body through the one-way air outlet channel 6, the first corner point and the second corner point of the one-way air outlet channel 6 force the air to change the flowing direction twice, thereby forming a huge resistance.

In the process of squeezing, the air in the bag body is largely distributed at the center of the bottom of the bag body. Therefore, by arranging the air inlet opening 60 to face the center of the bottom of the vacuum compression bag, the air in the bag body can be expelled to the outside more quickly.

Embodiment 2

Figure 4:
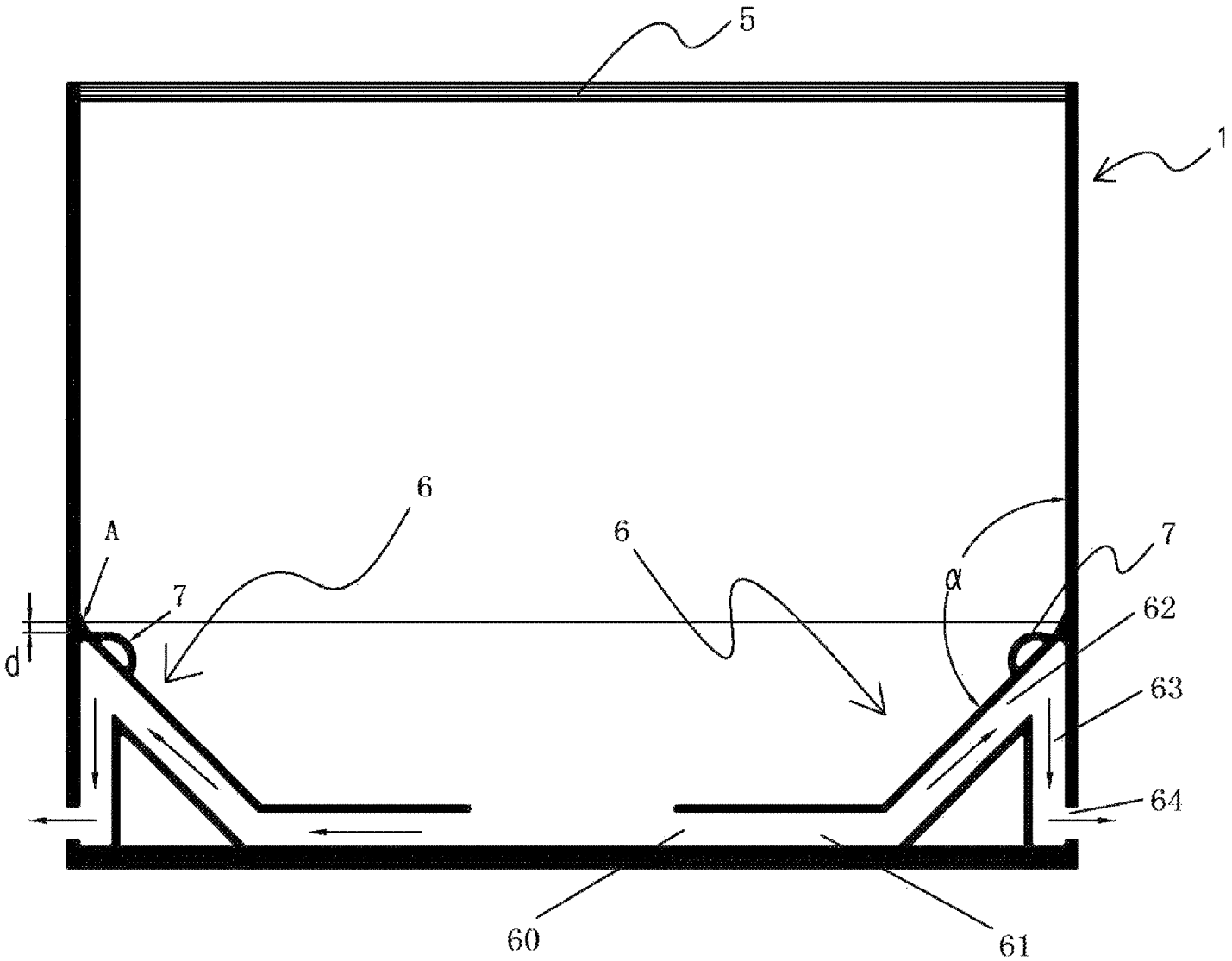
FIG. 4 is a front view of the vacuum plastic bag with one-way air outlet channel in embodiment 2.

As shown in FIG. 4, the difference between the embodiment 2 and the embodiment 1 is as follows.

The one-way air outlet channel 6 is further provided with an arc-shaped hot press block 7, which is specifically located at the position where the obtuse angle α is formed between the inclined air channel 62 and the third lateral side, such that the arc-shaped hot press block 7 can be used to disperse the stress concentrated here in the process of pressing and expelling air.

A junction A is formed between the first lateral side, the second lateral side and the third lateral side. The distance between the horizontal tangent of the arc-shaped hot press block 7 and the junction A is d, and d ranges from 5 to 20 mm. With the distance within this range, a good tear-proof effect can be achieved.

Embodiment 3

Figure 5:
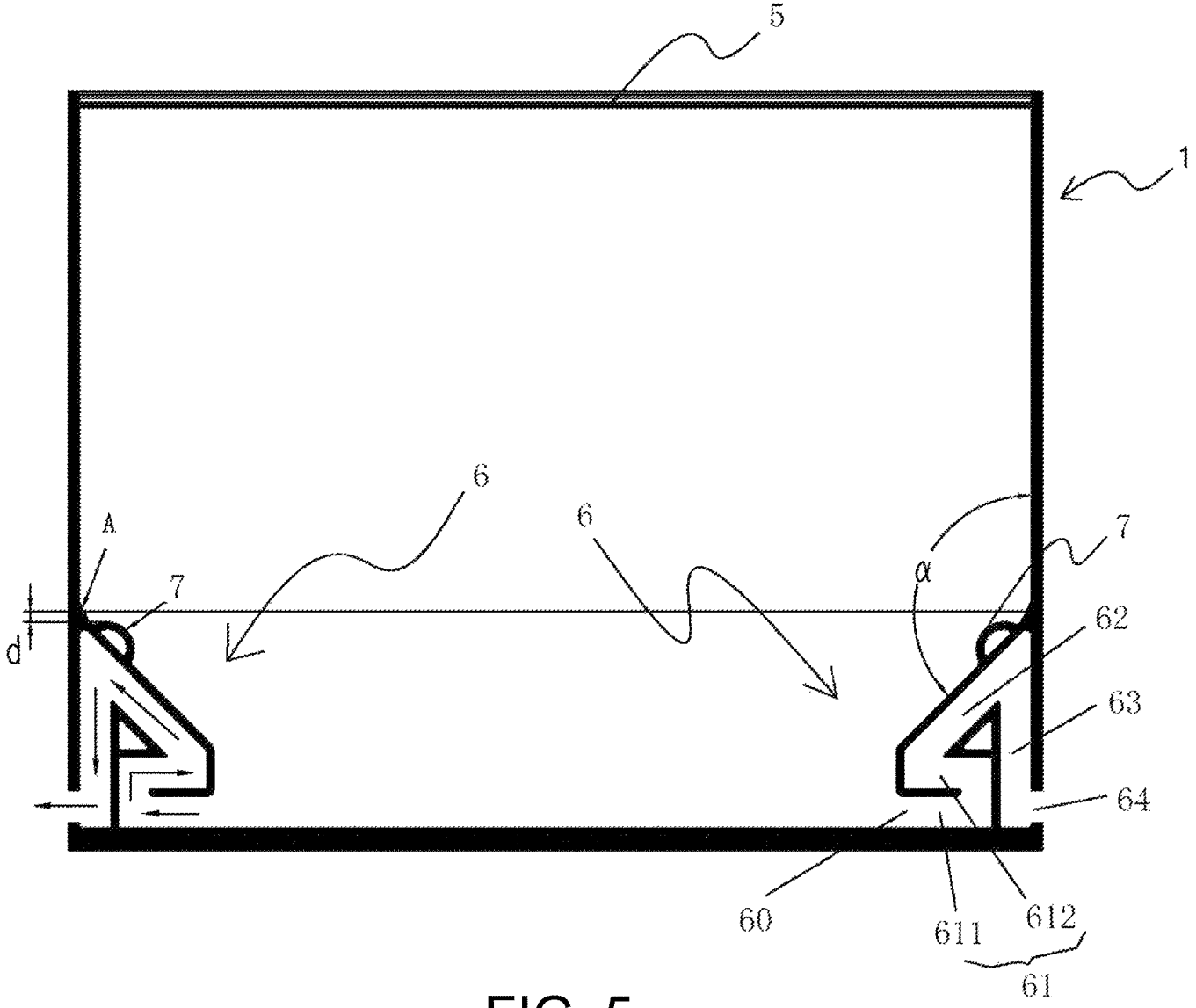
FIG. 5 is a first front view of the vacuum plastic bag with one-way air outlet channel in embodiment 3.

As shown in FIG. 5, the difference between the embodiment 3 and the embodiment 2 is as follows.

The horizontal air channel 61 includes a first horizontal air channel 611 and a second horizontal air channel 612. The first horizontal air channel 611 and the second horizontal air channel 612 are in communication with each other. A corner point is formed between the first horizontal air channel 611 and the second horizontal air channel 612, so that the horizontal air channel 61 forms a U-shaped structure. The air inlet opening 60 is located at one end of the first horizontal air channel 611 away from the second horizontal air channel 612, and one end of the second horizontal air channel 612 away from the first horizontal air channel 611 is in communication with the inclined air channel 62.

With the one-way air outlet channel 6 designed in this way, the number of corner points increases from two to four. The air from the outside must change flowing direction four times in order to pass through the one-way air outlet channel 6 to return to the bag body. In this way, the resistance is further increased, and airtightness is improved.

Figure 6:
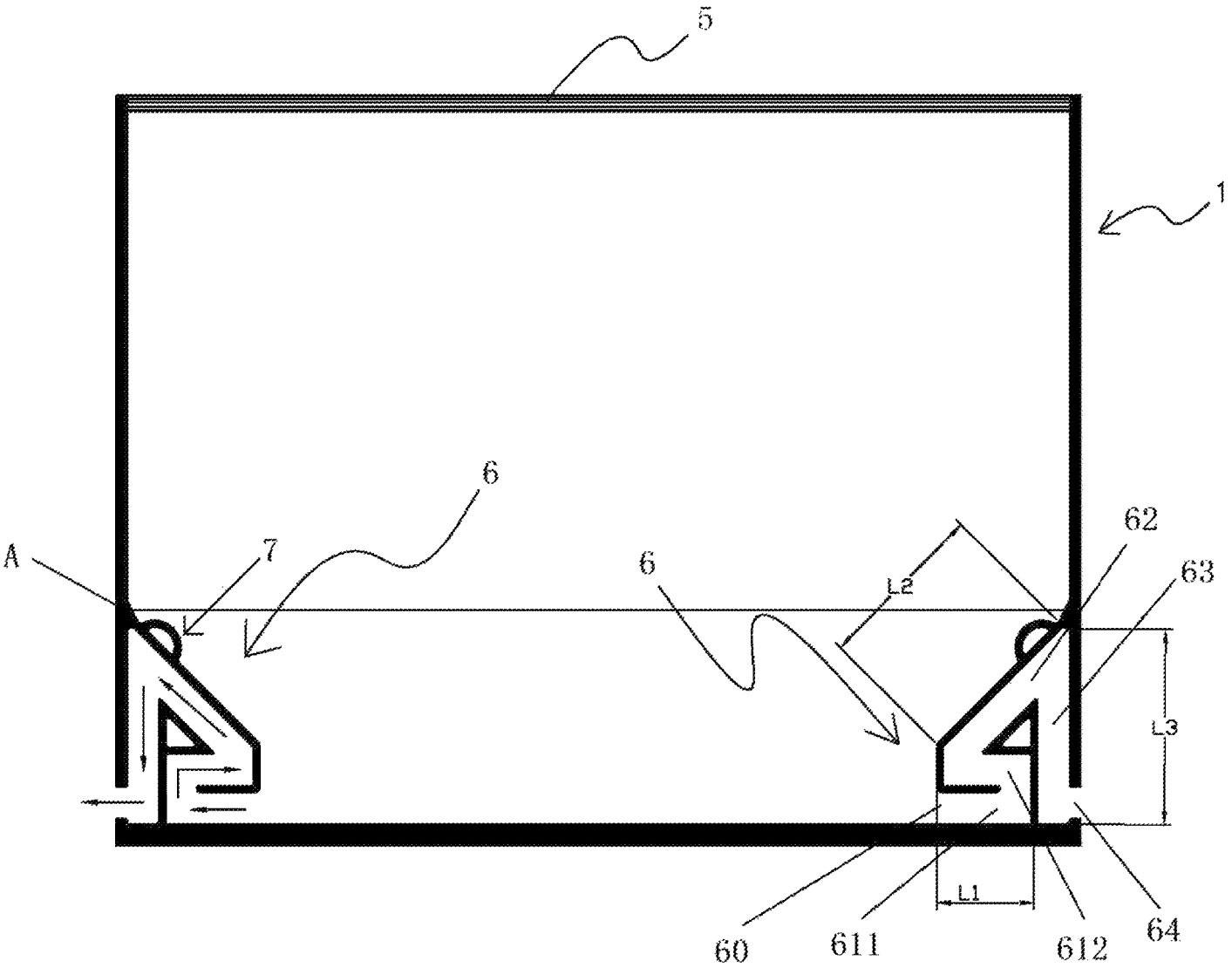
FIG. 6 is a second front view of the vacuum plastic bag with one-way air outlet channel in embodiment 3.

As shown in FIG. 6, a length of the first horizontal air channel 611 and a length of the second horizontal air channel 612 are both L1, and L1 ranges from 40 to 150 mm. A length of the inclined air channel 62 is L2, and L2 ranges from 100 to 250 mm. A length of the vertical air channel 63 is L3, and L3 ranges from 100 to 300 mm. The lengths within this range allow the one-way air outlet channel 6 to have a sufficient length and thus it is more difficult for the air to flow back, which further improves the airtightness of the vacuum compression bag.

The diameters of the air inlet opening 60, the horizontal air channel 61, the inclined air channel 62, the vertical air channel 63 and the air outlet opening 64 range from 20 to 60 mm. The diameters within this range can make the one-way air outlet channel 6 to achieve an ideal air-expelling effect.

Embodiment 4

Figure 7:
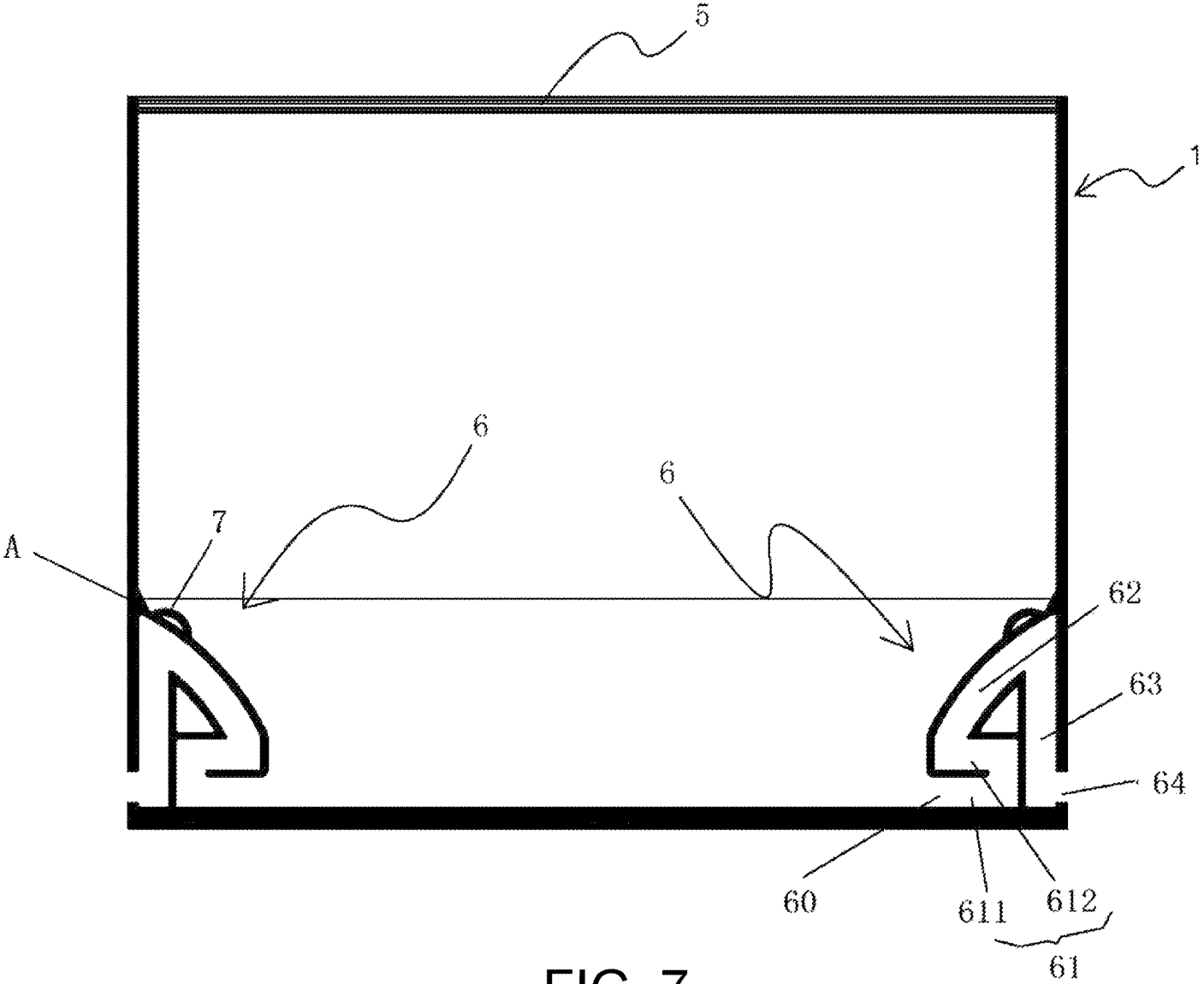
FIG. 7 is a front view of the vacuum plastic bag with one-way air outlet channel in embodiment 4.

As shown in FIG. 7, the difference between embodiment 4 and embodiment 3 is as follows.

The inclined air channel 62 is an arc-shaped air channel.

Either the linear inclined air channel 62 in the embodiment 2 and the embodiment 3 or the linear inclined air channel 62 in the embodiment 4 can achieve a good sealing effect.

Embodiment 5

Figure 8:
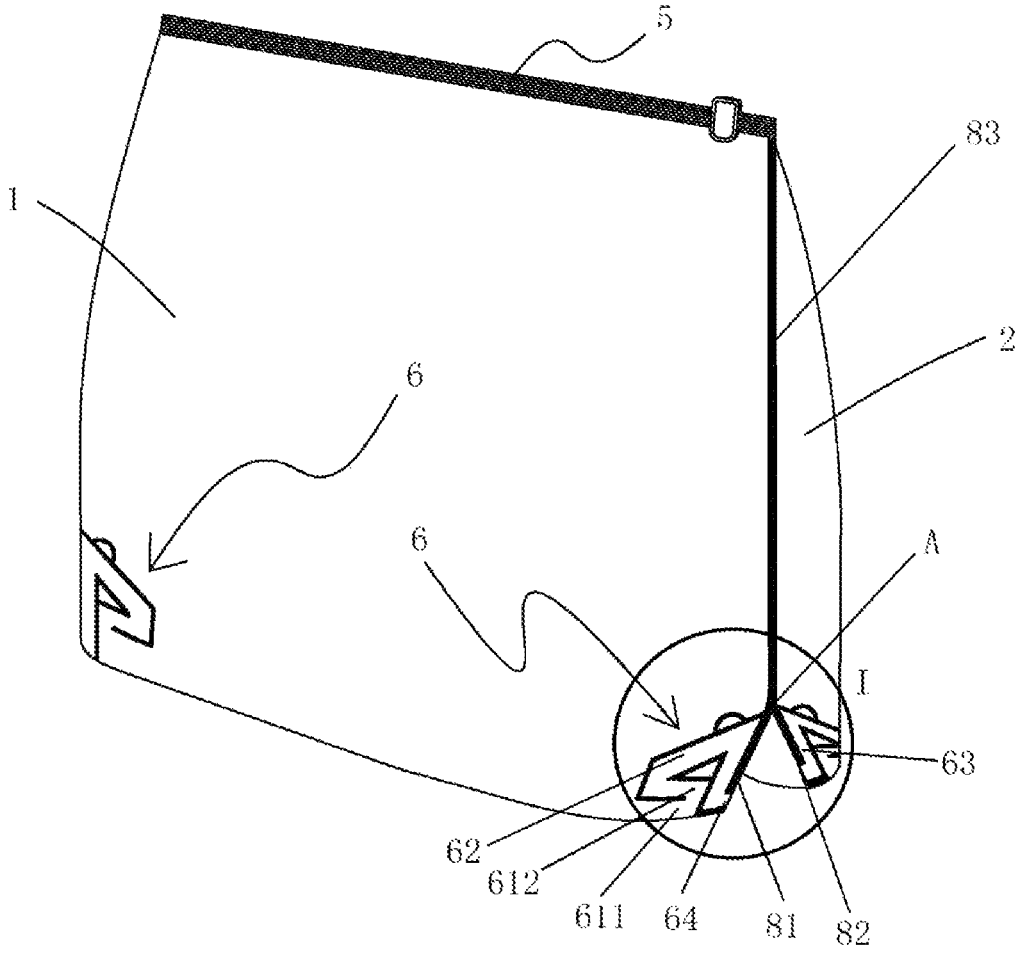
FIG. 8 is a perspective view of the vacuum plastic bag with one-way air outlet channel in embodiment 5.
Figure 9:
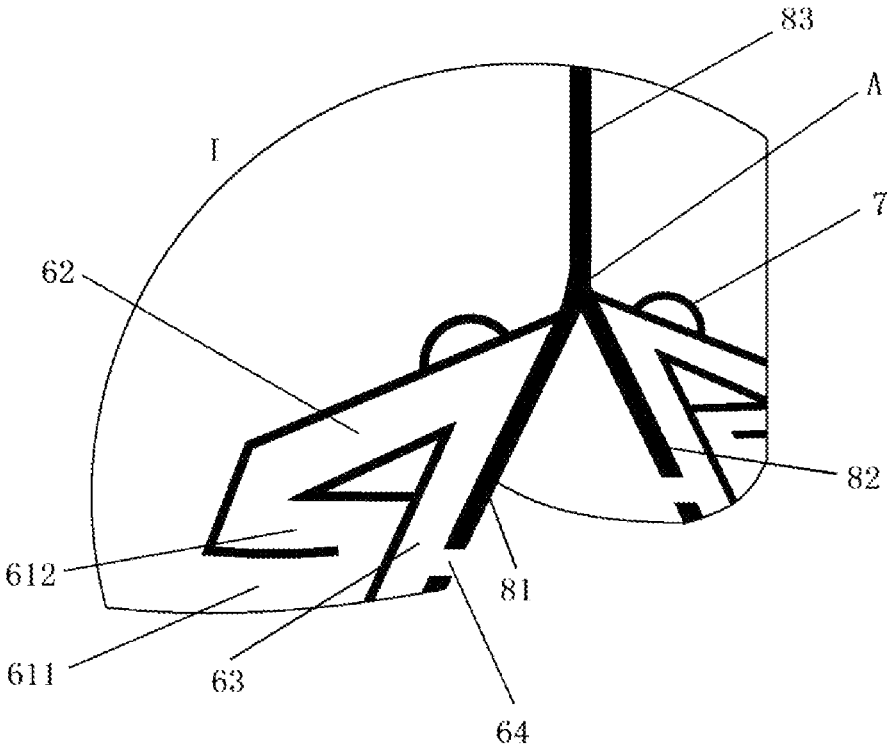
FIG. 9 is a partial enlarged view of part I in FIG. 8.

A shown in FIG. 8 and FIG. 9, the difference between the embodiment 5 and the embodiment 3 is as follows.

Four one-way air outlet channels 6 are provided in the vacuum compression bag. Two of the one-way air outlet channels 6 are provided between the front bag panel 1 and the first bottom surface 31. The vertical air channels 63 of the two one-way air outlet channels 6 are respectively closely attached to the first lower lateral side 81 on the left and right sides, and each of the vertical air channels 63 is close to the junction A formed by the first lower lateral side 81, the second lower lateral side 82 and the third lateral side 83. The other two of the one-way air outlet channels 6 are arranged between the rear bag panel 2 and the second bottom surface 32. The vertical air channels 63 of the two one-way air outlet channels 6 are respectively closely attached to the second lower lateral side 82 on the left and right sides, and each of the vertical air channels 63 is close to the junction A formed by the first lower lateral side 81, the second lower lateral side 82 and the third lateral side 83. That is, a one-way air outlet channel 6 is provided at each of the four corners of the vacuum compression bag formed between the first bottom surface 31 and the front bag panel 1, and between the second bottom surface 32 and the rear bag panel 2.

Embodiment 6

Figure 10:
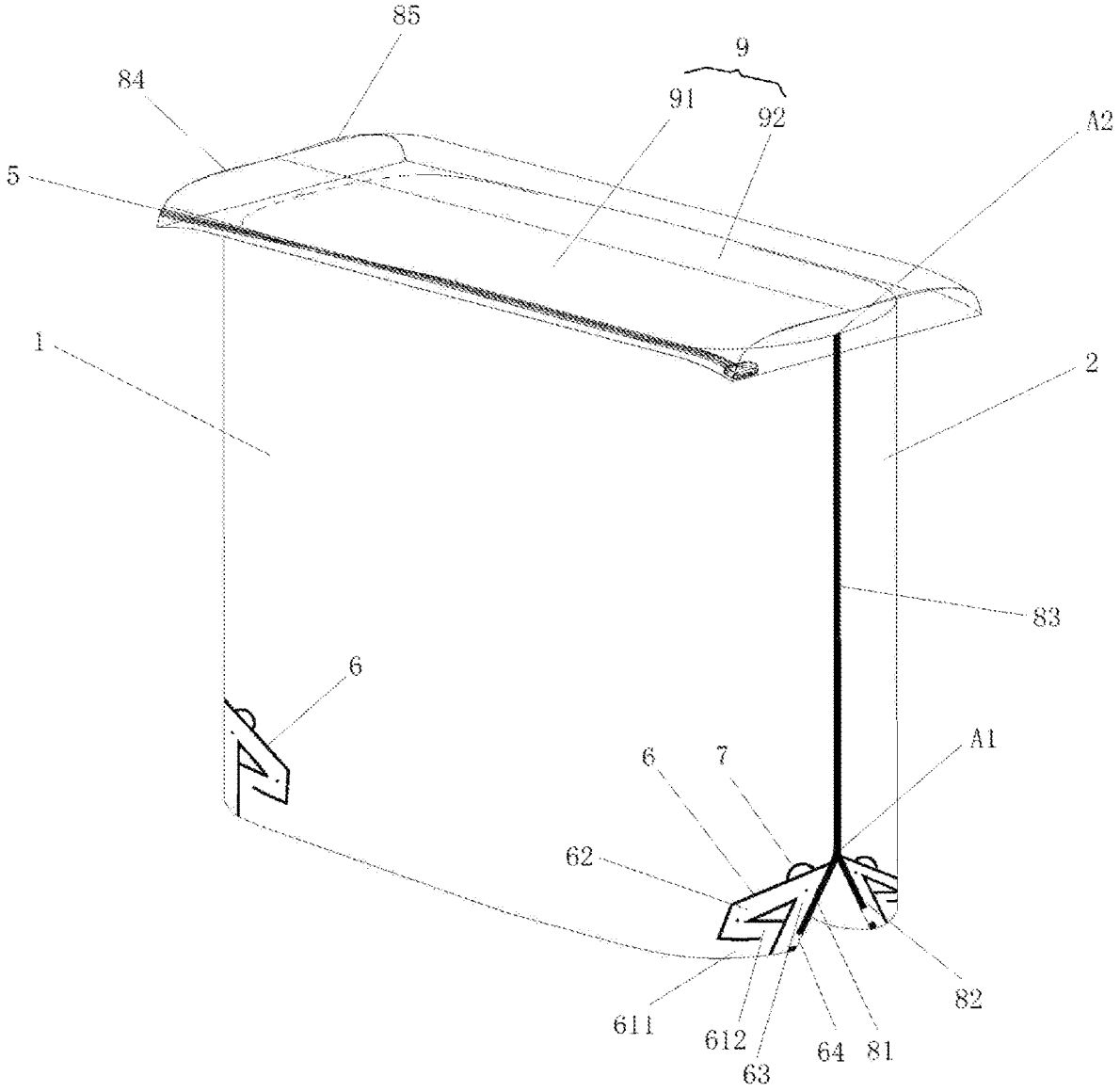
FIG. 10 is a perspective view of the vacuum plastic bag with one-way air outlet channel in embodiment 6.

As shown in FIG. 10, the difference between the embodiment 6 and the embodiment 5 is as follows.

The vacuum compression bag has a split structure at the top and bottom. In addition to the front bag panel 1, the rear bag panel 2 and the bottom bag panel 3, the bag body further includes a top bag panel 9. The top bag panel 9 is divided into a first top surface 91 and a second top surface 92 along a fold line. The two lateral sides of the first top surface 91 are respectively pressed against the upper sections of two lateral sides of the front bag panel 1 to form a first upper lateral side 84. The two lateral sides of the second top surface 92 are respectively pressed against the upper sections of the two lateral sides of the rear bag panel 2 to form a second upper lateral side 85. A bag opening is formed between the outer edge of the first top surface 91 and the top edge of the front bag panel 1, and a buckle mechanism 5 is arranged at the bag opening.

The third lateral side 83 is the remaining portions of the two lateral sides of the front bag panel 1 and the rear bag panel 2. The junction A1 is formed by the first lower lateral side 81, the second lower lateral side 82 and the third lateral side 83. The junction A2 is formed by the first upper lateral side 84, the second upper lateral side 85 and the third lateral side 83.

Embodiment 7

Figure 11:
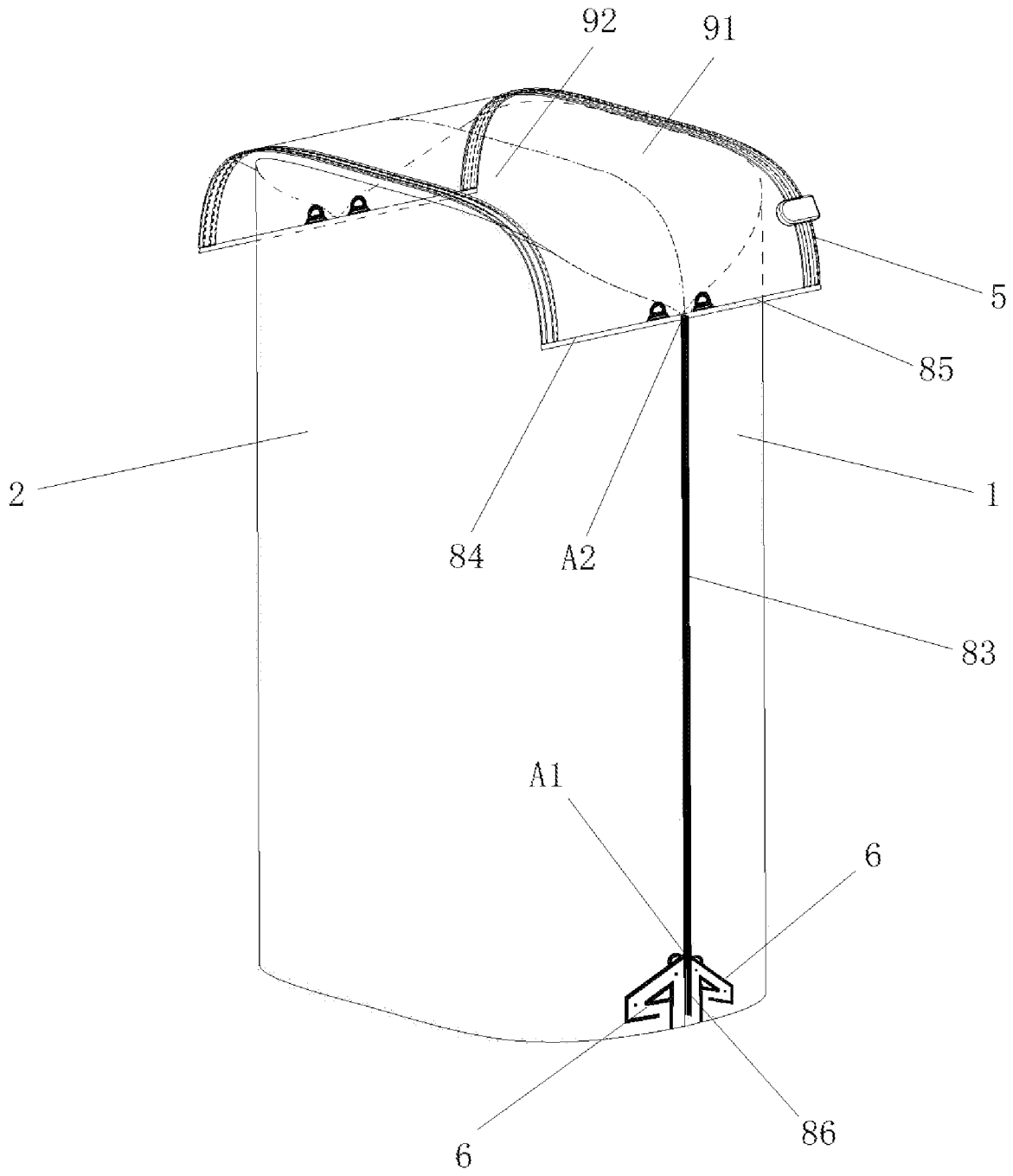
FIG. 11 is a perspective view of the vacuum plastic bag with one-way air outlet channel in embodiment 7.

As shown in FIG. 11, the difference between the embodiment 7 and the embodiment 6 is as follows.

The first lower lateral side 81 and the second lower lateral side 82 are pressed together to form a reinforced lateral side 86.

Comparative Examples 1-5

As shown in FIG. 12 to FIG. 16, the bag body in comparative examples 1-5 is the same as embodiment 1 and embodiment 3, but the structure of the air outlet channel is different.

Figure 12:
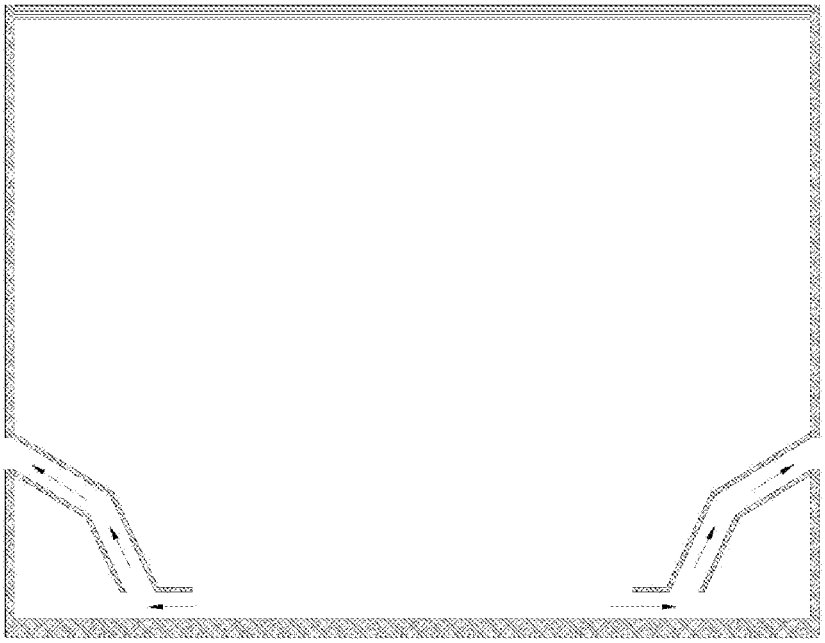
FIG. 12 to FIG. 16 are front views of the vacuum plastic bag with one-way air outlet channel in comparative examples 1 to 5.

As shown in FIG. 12, the one-way air outlet channel in comparative example 1 includes horizontal air channels that are in communication in sequence and two inclined air channels with different inclination angles. The air inlet opening is located at one end of the horizontal air channel, and the air outlet opening is located at the terminal end of the second inclined air channel.

Figure 13:
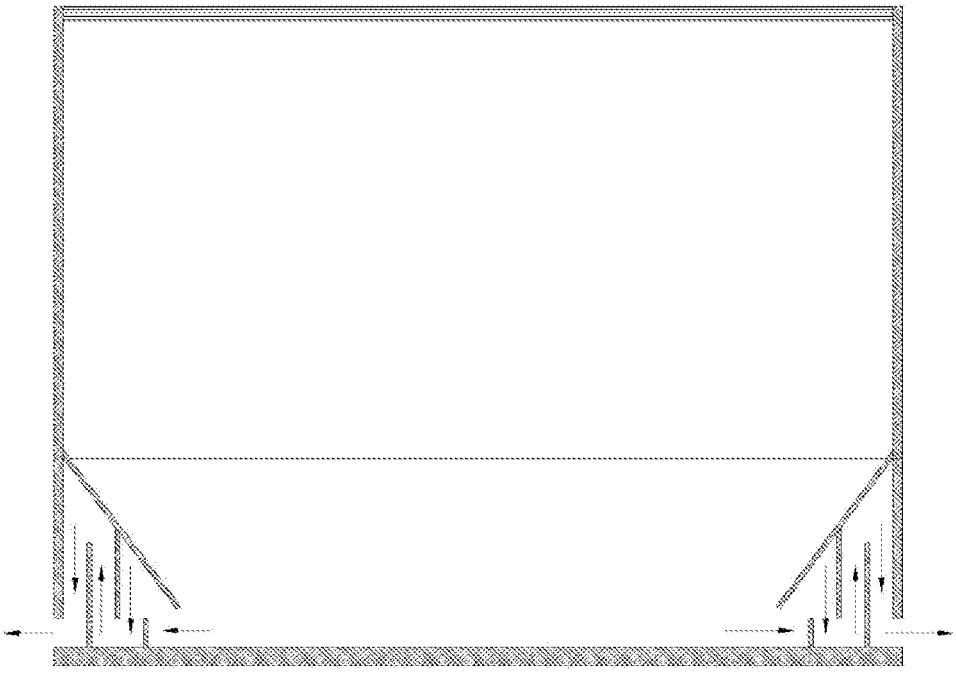

As shown in FIG. 13, the one-way air outlet channel in comparative example 2 includes three vertical air channels arranged side by side, forming three U-shaped structures.

Figure 14:
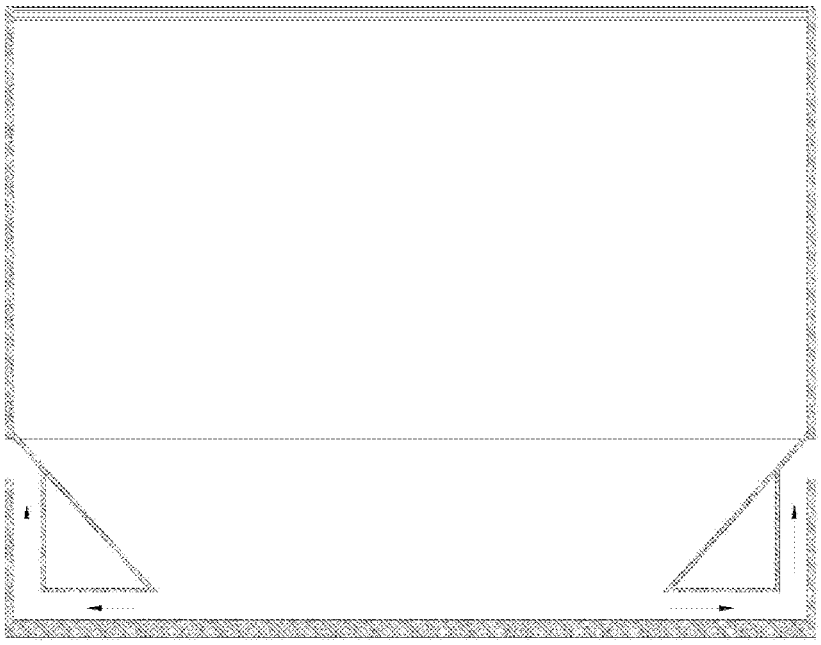

As shown in FIG. 14, the one-way air outlet channel in comparative example 3 includes a horizontal air channel and a vertical air channel that are perpendicular to each other.

Figure 15:
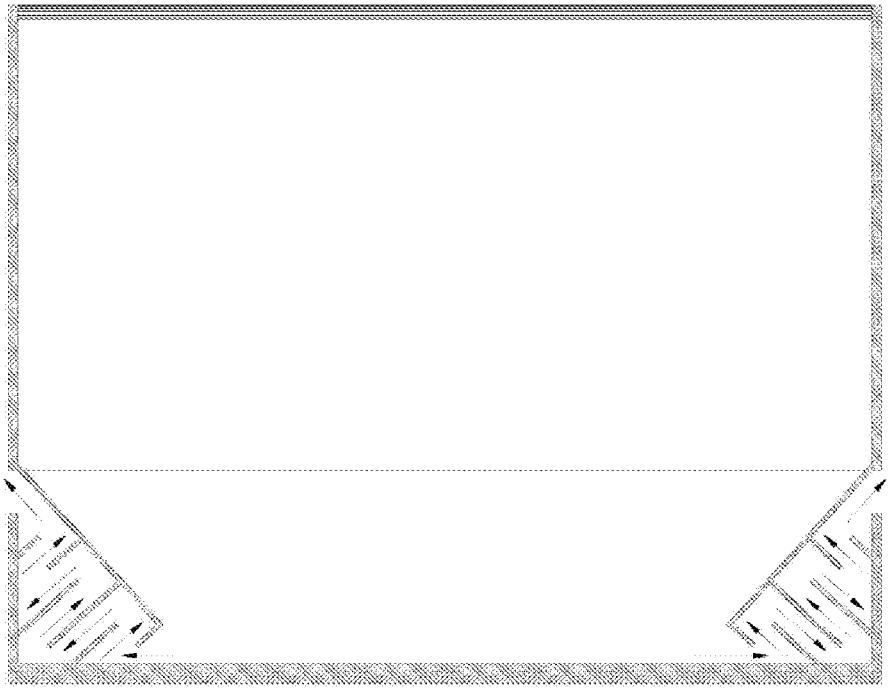

As shown in FIG. 15, the one-way air outlet channel in comparative example 4 includes a plurality of inclined channels arranged side by side, and adjacent inclined channels form a U-shaped structure.

Figure 16:
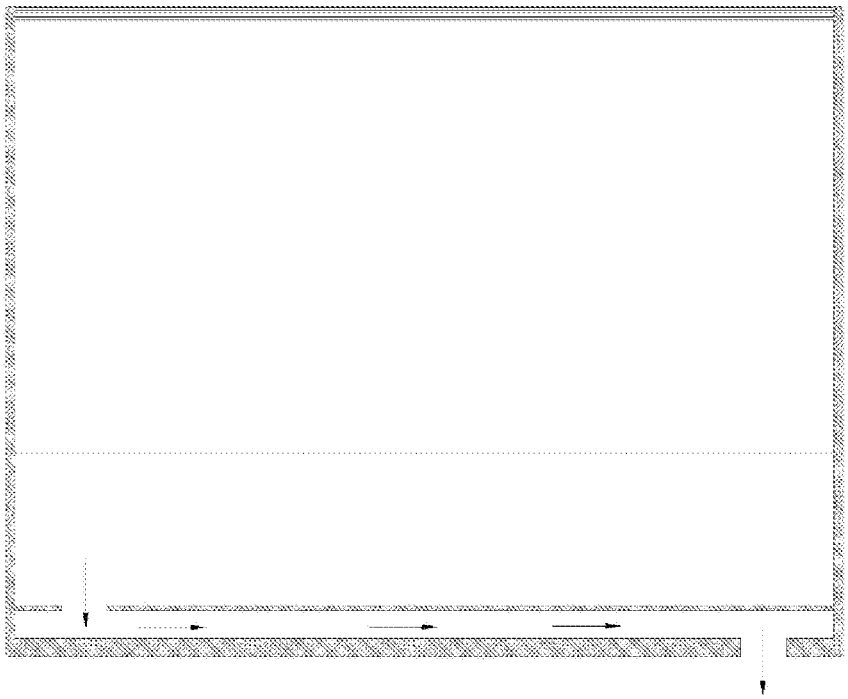

As shown in FIG. 16, the one-way air outlet channel in comparative example 5 includes a horizontal air channel, and the air inlet opening and the air outlet opening are respectively located at both ends of the horizontal air channel.

Vacuum sealing effect tests were performed on embodiments 1 to 7 and comparative examples 1 to 5. The bag opening was sealed by the buckle mechanism after the objects were placed in the bag body, and the bag body was squeezed to expel the air in the bag body to the outside, so that the inside of the bag body is in a vacuum state. Then the vacuum compression bag in the vacuum state was kept for 30 days (in accordance with the standard procedure for a vacuum compression bag, the minimum requirement of airtightness is that there is no air leakage for 30 days under the sealing state). Then, the day when the air leakage start to occur was recorded.

The experiment results are as follows.

| | Embodiment 1 | Embodiment 2 | Embodiment 3 | Embodiment 4 | Embodiment 5 | Embodiment 6 | Embodiment 7 |
|---|---|---|---|---|---|---|---|
| Experiment Result | No air leakage in 30 days | No air leakage in 30 days | No air leakage in 30 days | No air leakage in 30 days | No air leakage in 30 days | No air leakage in 30 days | No air leakage in 30 days |

| | Comparative example 1 | Comparative example 2 | Comparative example 3 | Comparative example 4 | Comparative example 5 |
|---|---|---|---|---|---|
| Experiment result | No air leakage in 1 day | No air leakage in 3 days | No air leakage in 1 day | No air leakage in 2 days | No air leakage in 30 days |

It can be seen from the experiment results in the above table that the one-way air outlet channel with the structure of comparative examples 1 to 4 start to have air leakage within only 1 to 3 days. Such one-way air outlet channel has unsatisfactory sealing effect and is unable to achieve the requirement for vacuum compression bag. For comparative example 5, although there is no air leakage within 30 days, it occupies a relatively large space in the bag body, which is unsatisfactory for use.

In embodiments 1 to 7, no air leakage occurred within 30 days, and the space in the bag body occupied by the one-way air outlet channel is small, which can well meet the requirement of use.

It should be pointed out that the above-mentioned embodiments are only a further description of the invention, rather than a limitation. Any adjustment or change within the meaning and scope equivalent to the technical solution of the invention by those skilled in the art should be considered as involved in the scope of the invention.

What is claimed is:

1. A one-way air outlet channel, adapted for a vacuum compression bag, the vacuum compression bag having a bag body that has a split structure, the bag body of the vacuum compression bag including a front bag panel, a rear bag panel, and at least one connecting panel, wherein the at least one connecting panel is divided into a first connecting surface and a second connecting surface along a fold line, the one-way air outlet channel is made of a flexible material, is adapted to be arranged in the vacuum compression bag, and is adapted to be located between the front bag panel and the first connecting surface and/or between the rear bag panel and the second connecting surface, the one-way air outlet channel comprising an air inlet opening, a horizontal air channel, an inclined air channel, a vertical air channel, and an air outlet opening arranged in communication with one another in sequence, a length of the inclined air channel is 100 mm to 250 mm, and a length of the vertical air channel is 100 mm to 300 mm, wherein the air outlet opening in communication with the outside is adapted to be provided on the bag body of the vacuum compression bag, wherein a bottom end of the vertical air channel is in communication with the air outlet opening, and the air outlet opening is adapted to be arranged on a lateral side of the bag body close to a bottom edge or a top edge of the bag body, and wherein a top end of the vertical air channel is in communication with the inclined air channel, such that at least two corner points are formed at a location where the horizontal air channel connects to the inclined air channel and at a location where the inclined air channel connects to the vertical air channel, wherein the horizontal air channel is adapted to be arranged along the top edge or the bottom edge of the bag body, the air inlet opening is adapted to face a center of the top edge or a center of the bottom edge of the vacuum compression bag, wherein the horizontal air channel comprises a first horizontal air channel section and a second horizontal air channel section, the first horizontal air channel section and the second horizontal air channel section are parallel with each other, the air inlet opening is located at one end of the first horizontal air channel section, and the other end of the first horizontal air channel section communicates with one end of the second horizontal air channel section, and a corner point is formed between the first horizontal air channel section and the second horizontal air channel, such that the first horizontal air channel section, the corner point, and the second horizontal air channel section cooperatively form a U-shaped structure, the other end of the second horizontal air channel section communicates with the inclined air channel, a length of the first horizontal air channel is 40 mm to 150 mm, and a length of the second horizontal air channel is 40 mm to 150 mm.

2. The one-way air outlet channel according to claim 1, wherein the one-way air outlet channel is adapted to be formed by pressing the front bag panel and the first connecting surface and/or pressing the rear bag panel and the second connecting surface.

3. The one-way air outlet channel according to claim 1, wherein the one-way air outlet channel is adapted to be arranged at a corner of the vacuum compression bag.

4. The one-way air outlet channel according to claim 1, wherein the inclined air channel is a straight inclined air channel or an arc inclined air channel.

5. The one-way air outlet channel according to claim 1, wherein diameters of the air inlet opening, the horizontal air channel, the inclined air channel, the vertical air channel and the air outlet opening are 20 to 60 mm.

6. The one-way air outlet channel according to claim 1, wherein an obtuse angle is formed between the inclined air channel and the lateral side of the bag body, and the obtuse angle ranges from 120° to 160°.

7. A vacuum compression bag, comprising the one-way air outlet channel according to claim 1, wherein:

the connecting panel is a bottom bag panel, two lateral sides of the first connecting surface are respectively pressed against a lower end section of two lateral sides of the front bag panel to form first lower lateral sides;

two lateral sides of the second connecting surface are respectively pressed against a lower end section of two lateral sides of the rear bag panel to form second lower lateral sides;

remaining portions of the two lateral sides of the front bag panel and remaining portions of the two lateral sides of the rear bag panel are pressed against each other to form third lateral sides, the first lower lateral sides, the second lower lateral sides and the third lateral sides together form respective lateral sides of the bag body;

a bag opening is formed at an upper end of the bag body or formed by a top edge of the front bag panel and a top edge of the rear bag panel; and the one-way air outlet channel is provided in the bag body.

8. The vacuum compression bag according to claim 7, wherein the bag body further includes a top bag panel, which forms a split structure with an upper part of the bag body, the top bag panel is divided into a first top surface and a second top surface along a fold line, an outer edge of the second top surface parallel to the fold line is pressed against the top edge of the rear bag panel to form a first top edge, the bag opening is formed between an outer edge of the first top surface parallel to the fold line and the top edge of the front bag panel; two lateral sides of the first top surface are respectively pressed against upper sections at the two lateral sides of the front bag panel to form first upper lateral sides, two lateral sides of the second top surface are respectively pressed against upper sections at the two lateral sides of the rear bag panel to form second upper lateral sides, the remaining portions of the two lateral sides of the front bag panel and the remaining portions of the two lateral sides of the rear front panel are pressed against each other to form the third lateral sides, the third lateral sides extend from the first lower lateral sides and the second lower lateral sides to the first upper lateral sides and the second upper lateral sides.

9. The vacuum compression bag according to claim 8, wherein a top surface of the top bag panel is provided with an interposing layer, and an accommodating space is formed between the interposing layer and the top surface of the top bag panel for a hard press plate to be movably inserted therein.

10. The vacuum compression bag according to claim 7, wherein the bottom bag panel is divided into a first bottom surface serving as the first connecting surface and a second bottom surface serving as the second connecting surface along the fold line, an outer edge of the first bottom surface parallel to the fold line is pressed against the bottom edge of the front bag panel to form a first bottom edge, an outer edge of the second bottom surface parallel to the fold line is pressed against the bottom edge of the rear bag panel to form a second bottom edge.

11. The vacuum compression bag according to claim 10, wherein each of the first lower lateral sides and a respective one of the second lower lateral sides are pressed together to form a reinforced lateral side.

12. The vacuum compression bag according to claim 10, wherein the one-way air outlet channel is provided at each of the four corners of the vacuum compression bag formed between the first bottom surface and the front bag panel, and between the second bottom surface and the rear bag panel.

13. The vacuum compression bag according to claim 7, wherein an obtuse angle is formed between the inclined air channel of the one-way air outlet channel and the lateral side of the bag body, the one-way air outlet channel is provided with a tear-proof arc-shaped hot press block arranged at a position where the obtuse angle forms.

14. The vacuum compression bag according to claim 13, wherein a junction is formed among the first lateral side, the second lateral side and the third lateral side, a distance between a horizontal tangent of the arc-shaped hot press block and the junction ranges from 5 to 20 mm; the first lateral side is the first upper lateral side or the first lower lateral side; the second lateral side is the second upper lateral side or the second lower lateral side.

* * * * *